US010683608B2

(12) United States Patent
Rommel et al.

(10) Patent No.: US 10,683,608 B2
(45) Date of Patent: Jun. 16, 2020

(54) CUT RESISTANT ROPE

(71) Applicant: BEKAERT ADVANCED CORDS AALTER NV, Aalter (BE)

(72) Inventors: Hendrik Rommel, Sint-Michiels (BE); Veerle Van Wassenhove, Aarsele (BE); Thomas Hanselaer, Gentbrugge (BE)

(73) Assignee: BEKAERT ADVANCED CORDS AALTER NV, Aalter (BE)

( * ) Notice: Subject to any disclaimer, the term of this patent is extended or adjusted under 35 U.S.C. 154(b) by 749 days.

(21) Appl. No.: 15/310,340

(22) PCT Filed: May 8, 2015

(86) PCT No.: PCT/EP2015/060147
§ 371 (c)(1),
(2) Date: Nov. 10, 2016

(87) PCT Pub. No.: WO2015/173129
PCT Pub. Date: Nov. 19, 2015

(65) Prior Publication Data

US 2017/0145631 A1 May 25, 2017

(30) Foreign Application Priority Data

May 13, 2014 (EP) ..... 14168095

(51) Int. Cl.
*D07B 1/02* (2006.01)
*D04B 21/14* (2006.01)
(Continued)

(52) U.S. Cl.
CPC ..... *D07B 1/02* (2013.01); *D03D 3/005* (2013.01); *D04B 21/14* (2013.01); *D07B 1/025* (2013.01);
(Continued)

(58) Field of Classification Search
CPC ..... D07B 1/02; D03D 3/005
See application file for complete search history.

(56) References Cited

U.S. PATENT DOCUMENTS

| | | | | |
|---|---|---|---|---|
| 2,032,712 | A | 3/1936 | Morrison et al. | |
| 4,684,762 | A * | 8/1987 | Gladfelter | D03D 15/00 174/36 |
| 4,886,691 | A | 12/1989 | Wincklhofer | |
| 5,216,202 | A * | 6/1993 | Yoshida | H01B 7/182 174/106 R |
| 5,234,058 | A | 8/1993 | Sas-Jaworsky et al. | |
| 8,487,184 | B2 * | 7/2013 | Rivernider, Jr. | H01B 11/1033 174/102 R |
| 2004/0265582 | A1 | 12/2004 | Connolly, Jr. | |

(Continued)

FOREIGN PATENT DOCUMENTS

| | | | |
|---|---|---|---|
| CN | 201994104 | U | 9/2011 |
| DE | 2015898 | A1 | 12/1971 |

(Continued)

OTHER PUBLICATIONS

International Search Report (ISR) dated Aug. 17, 2015, for PCT/EP2015/060147.

(Continued)

*Primary Examiner* — Shaun R Hurley
(74) *Attorney, Agent, or Firm* — Bacon & Thomas, PLLC

(57) ABSTRACT

A rope having a core for providing strength to the rope, where at least a metal or composite woven or warp knitted fabric having multiple substantially parallel elongated metal elements is provided around the core for protecting said core from impact and cutting, and where the multiple substantially parallel elongated elements are in the warp direction and held by yarns.

14 Claims, 1 Drawing Sheet

(51) Int. Cl.
*D07B 5/02* (2006.01)
*D03D 3/00* (2006.01)

(52) U.S. Cl.
CPC ..... *D07B 5/02* (2013.01); *D07B 2201/209* (2013.01); *D07B 2201/2012* (2013.01); *D07B 2201/2015* (2013.01); *D07B 2201/2088* (2013.01); *D07B 2201/2089* (2013.01); *D07B 2201/2092* (2013.01); *D07B 2201/2095* (2013.01); *D07B 2201/20903* (2015.07); *D07B 2201/20907* (2015.07); *D07B 2205/103* (2013.01); *D07B 2205/106* (2013.01); *D07B 2205/201* (2013.01); *D07B 2205/205* (2013.01); *D07B 2205/2014* (2013.01); *D07B 2205/2032* (2013.01); *D07B 2205/2039* (2013.01); *D07B 2205/2042* (2013.01); *D07B 2205/2046* (2013.01); *D07B 2205/3021* (2013.01); *D07B 2205/3028* (2013.01); *D07B 2205/3046* (2013.01); *D07B 2401/202* (2013.01); *D07B 2401/2075* (2013.01); *D07B 2501/2061* (2013.01); *D10B 2101/20* (2013.01); *D10B 2403/02411* (2013.01); *D10B 2403/0311* (2013.01)

(56) References Cited

U.S. PATENT DOCUMENTS

| | | | | |
|---|---|---|---|---|
| 2007/0137163 | A1* | 6/2007 | Hess | D07B 1/02 57/210 |
| 2013/0122293 | A1 | 5/2013 | Weber et al. | |
| 2013/0247534 | A1 | 9/2013 | Canedo Duarte Da Rocha et al. | |
| 2015/0337490 | A1* | 11/2015 | Burdette, III | D07B 1/12 428/34.5 |

FOREIGN PATENT DOCUMENTS

| | | | |
|---|---|---|---|
| EP | 0790349 | A | 6/1997 |
| FR | 1284920 | A | 2/1962 |
| GB | 1294910 | A | 11/1972 |
| GB | 2249212 | A | 4/1992 |
| JP | H02-227018 | A | 9/1990 |
| WO | 2009/062764 | A1 | 5/2009 |

OTHER PUBLICATIONS

Anonymous: "Improved durability of ropes and cables of aramid fiber", Research Disclosure, Mason Publications Hampshire, GB, vol. 192, No. 25, Apr. 1, 1980.

* cited by examiner

CUT RESISTANT ROPE

The present invention relates to a rope, in particular to a cut resistant synthetic rope, and a method for producing such a rope.

BACKGROUND ART

Synthetic ropes and more particularly ropes made from high modulus polymeric material are desirable for great length suspended use, such as hauling or hoisting ropes in mining, cranes and elevators, aerial ropes or ropes for deep sea installations or use in marine and commercial fishing applications, and off-shore mooring. During such applications, the weight of rope by itself already takes up a large part of its load-bearing capacity and winch load capacity; the payload is correspondingly limited. Steel ropes have a disadvantage of being exceedingly heavy in long lengths. Therefore, in these operations synthetic high strength ropes are applied as they provide appropriate strength and lower weight expanding the possibilities, e.g. mooring deeper in the water.

However, in the application environment of such synthetic ropes, there is a risk that sharp and hard objects may impact on the ropes. As a consequence, the synthetic rope is damaged due to limited cut resistance. In addition, synthetic ropes have a poor resistance against transversal forces.

SUMMARY OF INVENTION

It is an object of the present invention to provide a cut resistant rope having light weight and being able to against impact or cutting.

It is still an object of the present invention to provide a cut resistant fabric as a cut resistant layer for synthetic ropes against impact or cutting.

It is yet another object of the present invention to provide a cut resistant fabric having reasonable flexibility, in particular for synthetic ropes, which would not create additional resistance when the ropes are moving in the sea.

According to the first aspect of the present invention, there is provided a rope comprising a core for providing strength to said rope, wherein at least a metal or composite fabric comprising multiple substantially parallel elongated metal elements is provided around said core for protecting said core from impact and cutting and wherein said multiple substantially parallel elongated elements are in the warp direction and held by yarns. The metal or composite fabric can be a woven fabric or a warp knitted fabric. Herein, the term "metal fabric" refers to a metal based material made through weaving, knitting, spreading, crocheting, or bonding. The metal based material may have polymeric coatings. Moreover, "metal fabric" may also comprise non-metal elements next to the metal elements, e.g. metal wires are woven with polymeric yarns or metal wires are bound by knitted polymeric yarns. The term "composite fabric" refers to a metal based material together with a fiber or polymer based material made through weaving, knitting, spreading, crocheting, or bonding. The composite fabric may further comprise multiple substantially parallel elongated fiber or polymer elongated elements alternating with the multiple substantially parallel elongated metal elements. Herein, "warp direction" means the direction runs lengthwise and parallel to the selvage (i.e. the self-finished edges of fabric). The metal fabric as such has rigidity along the warp, i.e. the longitudinal direction of the elongated metal elements.

When the rope provided with metal or composite fabric suffers impact or cutting of sharp objects, the yarns may be first broken while the metal cords is strong enough to against the cutting and does not break. The advantage of warp knitted fabric over woven fabric is that if the yarns are cut or broken at certain locations, the rest of the stitches of yarns will not get loose and are still in place and function. The metal or composite fabric remains in function except the yarns are partially broken. The warp knitted fabric may be obtained by a technique selected from mono-axial warp knitting, bi-axial warp knitting, raschel knitting and crochet knitting and/or mixtures thereof.

The metal or composite fabric acting as a cut resistant layer of ropes can be any type of metal element based textile products. Some examples of applicable metal element based textile products can be found in another application of the applicant WO2009/062764A1.

As an example, said metal or composite fabric may be in a form of strip and said strip is helically wrapped around said core. Since the fabric is merely stiff in the uni-direction along the longitudinal direction of elongated metal elements, it allows the fabric to be wrapped or wound. Therefore, the metal or composite fabric can be wrapped or wound on the core of rope with an inclination angle between the warp direction of the metal or composite fabric (i.e. the longitudinal direction of the elongated metal elements) and longitudinal direction of the rope. The inclination angle may be varied between 20 to 60°.

As a preferred example, two layers metal or composite fabrics are wrapped around said core with an angle in the range of 20° to 60° for one metal or composite fabric layer and with an angle in the range of −60° to −20° for another metal or composite fabric layer. One layer of metal or composite fabric may be directly wrapped on top of the other layer of metal or composite fabric. This configuration on the one hand provides better cut resistance, and on the other hand has a torsion balance.

The rope, in particular the core, according to the present invention has a light weight and the core of rope provides strength for the rope. The core can be made from natural or synthetic fibers. Common natural fibers for rope are manila hemp, hemp, linen, cotton, coir, jute, straw, and sisal. Synthetic fibers in use for rope-making include polypropylene, nylon, polyesters (e.g. PET, LCP, HDPE, Vectran), polyethylene (e.g. Dyneema and Spectra), Aramids (e.g. Twaron, Technora and Kevlar) and acrylics (e.g. Dralon). Some ropes are constructed of mixtures of several fibers or use co-polymer fibers. Preferably, said core is made from or high modulus polymeric material, such as High-density polyethylene (HDPE).

In the context of the present invention, the substantially parallel elongated metal element is to be understood as a metal wire, a bundle of metal wires, a metal strand or a metal cord. Herein, "substantially parallel" means that the elongated metal elements are parallel to each other (i.e. the inclination angle of longitudinal directions is close to zero) as well as the elongated elements have an inclination angle of longitudinal directions less than 30°, preferably less than 10°, and more preferably less than 5°. The elongated elements are preferably straight. However, they may have certain curvature or deformation especially at certain locations or parts. Optionally, the elements may have a diameter between about 0.2 and about 5 mm, preferably between about 0.3 and about 3 mm, more preferably between about 0.5 and about 3 mm and most preferably between about 1.5 and about 2 mm.

The elongated metal elements according to the invention are preferably of a type which can absorb relatively high amounts of impact energy but also other metal cords may be used. Examples here are:

multi-strand metal cords e.g. of the m×n type, i.e. metal cords, comprising m strands with each n wires, such as 7×3×0.15, 3×7×0.15 or 7×4×0.12, wherein the number with decimal point designates the diameter of each wire, expressed in mm.

compact cords or Seale strand, e.g. of the 1×n type, i.e. metal cords comprising n metal wires, n being greater than 8, twisted in only one direction with one single step to a compact cross-section, such as 12×0.22 wherein the number with decimal point is the diameter of each wire expressed in mm. The advantage to use compact cords or Seale strand is to provide better cut resistance.

layered metal cords e. g. of the I+m (+n) type, i. e. metal cords with a core of I wires, surrounded by a layer of m wires, and possibly also surrounded by another layer of n wires, such as 3×0.2+6×0.35, 3×0.265+9×0.245, 3+9×0.22, or 1×0.25+18×0.22, wherein the number with decimal point is the diameter of each wire expressed in mm.

single strand metal cords e.g. of the 1×m type, i. e. metal cords comprising m metal wires, m ranging from two to six, twisted in one single step, such as 3×0.48, 1×4×0.25; wherein the number with decimal point is the diameter of each wire expressed in mm .

metal cords e. g. of the m+n type, i.e. metal cords with m parallel metal wires surrounded by n metal wires, such as 2+2×0.38, 3+2×0.37, 3×0.48 or 3+4×0.35, wherein the number with decimal point is the diameter of each wire expressed in mm.

A metal element used in the context of the present invention may be a metal cord with a high elongation at fracture, i.e. an elongation exceeding 4%. High elongation metal cord has more capacity to absorb energy. Such a metal cord is:

either a high-elongation or elongation metal cord (HE-cords), i.e. a multi-strand or single strand metal cord with a high degree of twisting (in case of multi-strand metal cords: the direction of twisting in the strand is equal to the direction of twisting of the strands in the cord: SS or ZZ, this is the so-called Lang's Lay) in order to obtain an elastic cord with the required degree of springy potential; an example is 3×7×0.22 High Elongation metal cord with lay lengths 4.5 mm on the 7×0.22 strand and 8 mm for the strands in the steel cord in SS direction;

or a metal cord which has been subjected to a stress-relieving treatment such as disclosed in EP0790349A1; an example is a 4×7×0.25 SS cord.

The elongated metal elements are preferably steel cords. The tensile strength of the steel cords can range from 500 $N/mm^2$ to 2000 $N/mm^2$ and even more, and is mainly dependent upon the composition of the steel, the diameter of the cords and degree of cold deformation. The steel cords should on the one hand have sufficient strength to act against impact and should on the other hand have sufficient flexibility making it possible to be wrapped or wound on the core. The steel cords can be made from carbon steel. Such a steel generally may comprise a carbon content of at most 0.80 wt % C or at most 0.70 wt % C, but most preferably at most 0.50 wt % C, a manganese content ranging from 0.10 to 0.90 wt %, a sulfur and phosphorus content which are each preferably kept below 0.030 wt %, and additional micro-alloying elements such as chromium (up to 0.20 to 0.4 wt %), boron, cobalt, nickel, or vanadium. Also stainless steels are applicable. Stainless steels contain a minimum of 12 wt % Cr and a substantial amount of nickel. The possible compositions are known in the art as AISI (American Iron and Steel Institute) 25 302, AISI 301, AISI 304 and AISI 316.

The elongated metal elements can additionally be coated with adhesion promoters and/or corrosion protective layers. Preferably, the elongated metal elements are galvanized or have a zinc alloy coating, e.g. zinc aluminum coating. More preferably, on top of the zinc or zinc alloy coating, said elongated metal elements are individually coated with a polymer to further protect the metal elements against corrosion and abrasion. The thickness of the coated polymer on the elongated metal elements is in the range of 0.05 to 1 mm, preferably of 0.2 to 0.5 mm and more preferably of 0.3 to 0.4 mm. The coated polymer is any one selected from polyamide (PA), polyethylene (PE), polyethylene terephthalate (PET), polypropylene (PP), polyurethane (PU), polysulfone (PES), ethylene tetrafluoroethylene (ETFE), or their combination. Any traditionally available coating method can be applied and extrusion is preferred.

All elongated metal elements as described above can be equipped with one or more spiral wrapped wires to increase the mechanical bond of the elongated metal elements in the polymer coating, and/or to bundle the n single parallel crimped or non- crimped but plastically deformed wires if the cord is provided using such parallel wires.

The material of multiple substantially parallel elongated elements used for composite fabric may contain fibers or polymers of polyolefin, polyamide, thermoplastic polyester, polycarbonate, polyacetal, polysulfone, polyether ketone, polyimide or polyether fibers.

The multiple substantially parallel elongated elements are held by yarns. In the context of the present invention, the material used for yarns may be fibers or yarns of any suitable type of which the following are examples: glass, polyaramide, poly(p-phenylene-2,6-benzobisoxazole), carbon, mineral such as basalt, synthetic and natural rubber or natural yarns such as viscose, flax, cotton or hemp. It may also be metal yarn. It may be mixed with fibers or yarns of polymers like polyolefin, polyamide (PA), polyethylene (PE), polypropylene (PP), thermoplastic polyester, polycarbonate, polyacetal, polysulfone, polyether ketone, polyimide or polyether fibers. Preferably, said yarns are made from a same material as the coating on said elongated metal elements. When they are made from the same polymer, the yarns and the coating of the elongated metal elements are compatible and would not create undesired interaction. The yarns may have a diameter in the range from 0.05 to 1 mm, e.g. from 0.05 to 0.5 mm, from 0.1 to 0.3 mm, assuming round yarn shape. The yarns can be knitted or can be woven along the weft direction which is normal to the warp direction.

According to the present invention, the metal or composite fabric around the core is preferably an open fabric, and more preferably having a cover factor in the range of 0.5 to 0.9 and preferably in the range of 0.7 to 0.9. The cover factor defines the fraction of the surface area that is covered by metal or composite elements and yarns over the whole fabric area. The cover factor for closed fabric equals 1. The rope according to the present invention can be used as a mooring line or a submarine rope. When said rope is used for mooring lines or other submarine applications, great resistance can occur if the rope is not permeable to water and thus the rope is difficult to move. The rope wrapped with an open structure metal or composite fabric has sufficient water permeability. Therefore, the metal fabric can protect the rope from mechanical damage during handling and service, meanwhile and importantly be permeable for water to flood the rope core. The application of the metal or composite fabric would not create much additional resistance when the ropes as mooring lines are moving in the sea.

The ropes according to the present invention may have a cover of filter fabric incorporated between the rope core and the metal or composite fabric to block e.g. harmful soil particles. Preferably, the filter fabric is a non-woven fabric. More preferably, the metal or composite fabric is braided or stitched on said non-woven filter fabric. If the metal or composite fabric can be integrated with the non-woven filter fabric, the metal fabric and the filter layer can be applied by one winding process to the ropes and the compactness is even better.

A commonly used type of fiber rope for offshore moorings has a braided jacket to hold inner sub-ropes and provide protection. According to the present invention, the metal or composite fabric provides a same and better function of a traditional jacket, i.e. hold the inner part and provide protection. Therefore, a jacket may be omitted by applying the metal or composite fabric according to the present invention. However, preferably a jacket and more preferably a braided jacket, e.g. polyester or Nylon jacket, is applied on top of the metal fabric to prevent a possible early failure of the yarns. The braided jacket will provide a better flexibility compared with the extruded jacket and allows water permeability.

The jacket can have visible marking such as colored strands or brightly colored longitudinal elements/stripes incorporated in the rope for monitoring rope twist during installation.

BRIEF DESCRIPTION OF THE DRAWINGS

The invention will be better understood with reference to the detailed description when considered in conjunction with the non-limiting examples and the accompanying drawings, in which.

MODE(S) FOR CARRYING OUT THE INVENTION

Figure 1:
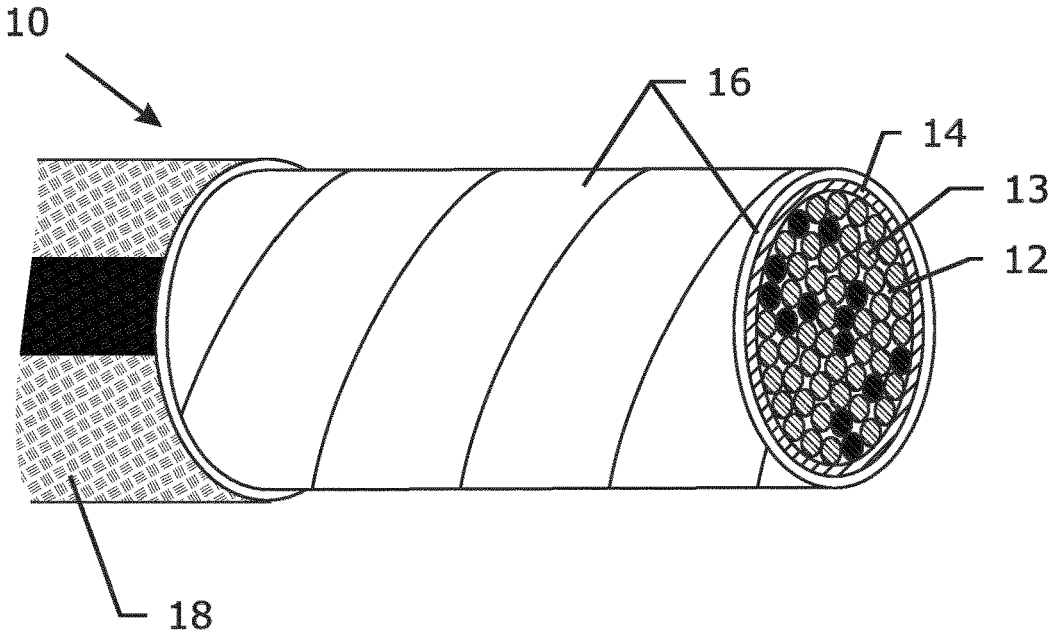
FIG. 1 schematically shows a rope according to the present invention.

FIG. 1 illustrates a rope 10 produced according to the present invention. As shown in FIG. 1, the core 12 of the rope is preferably made of synthetic yarns 13. The core may have any construction known for synthetic ropes. The core may have a plaited, a braided, a laid, a twisted or a parallel construction, or combinations thereof. Alternatively, the core may also be a combination of sub-ropes. Synthetic yarns 13 that may be used as the core of the rope according to the invention include all yarns, which are known for their use in fully synthetic ropes. Such yarns may include yarns made of fibers of polypropylene, nylon, polyester. Preferably, yarns of high modulus fibers are used, for example yarns of fibers of liquid crystal polymer (LCP), aramid such as poly(p-phenylene terephthalamide) (known as Kevlar®), high molecular weight polyethylene (HMwPE), ultra-high molecular weight polyethylene (UHMwPE) such as Dyneema® and PBO (poly(p-phenylene-2,6-benzobisoxazole). The high modulus fibers preferably have break strength of at least 2 MPa and tensile modulus preferably above 100 GPa. The diameter of the core 12 may vary between 2 mm to 300 mm. For example, the core 12 is made of a plurality of high modulus polyethylene (HMPE) yarns (e.g. any one or more of 8*1760 dTex Dyneema® SK78 yarn, 4*1760 dTex Dyneema® yarn or 14*1760 dTex Dyneema® 1760 dTex SK78 yarn) and has a diameter of 150 mm.

Preferably, the rope 10 has a filter fabric 14 around the core as a barrier for ingress of particles. The filter fabric 14 may be a non-woven cloth. As an example, a metal fabric 16 in a form of strip is wrapped or wound around the core 12 covered with a filter fabric 14.

Figure 2:
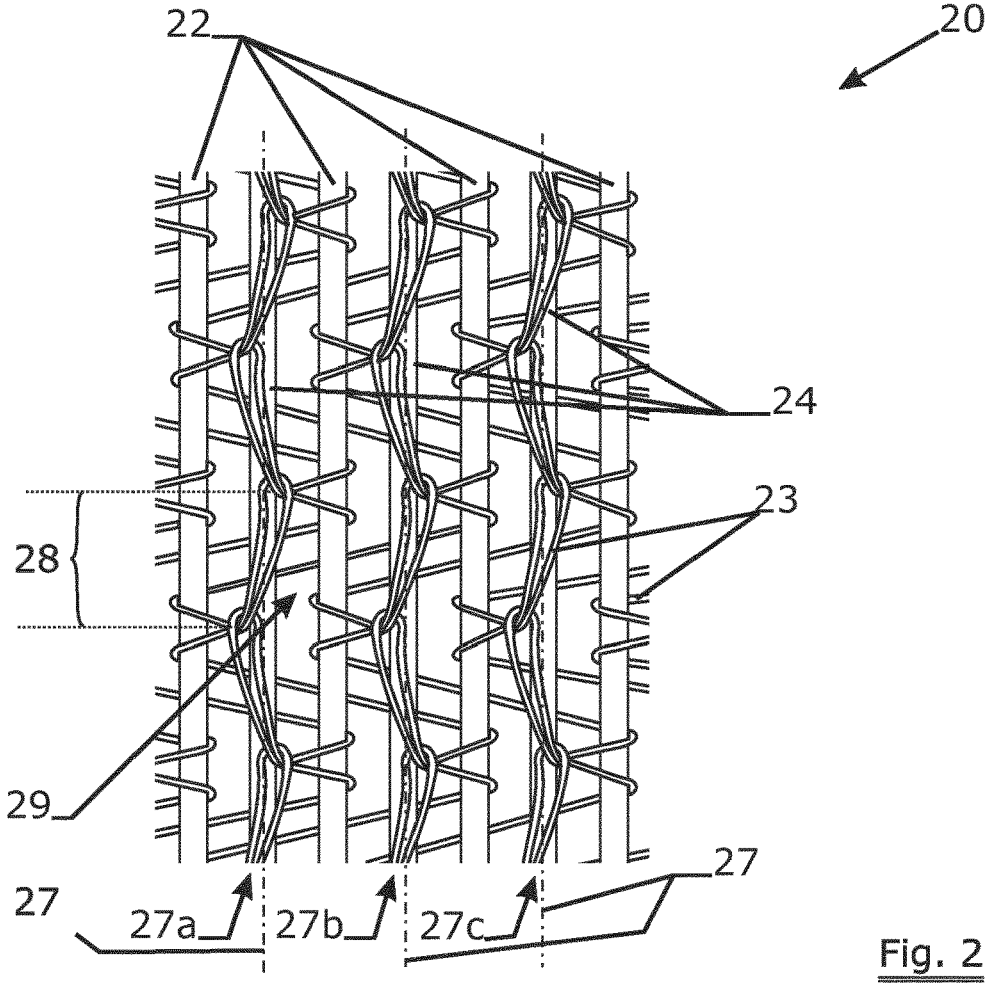
FIG. 2 illustrates an example of a metal or composite fabric applied on the rope according to the present application.

As an example shown in FIG. 2, the metal fabric is a warp knitted fabric 20. The warp direction is multiple of coated steel cords 22,24. The steel cords 22,24 have a carbon content less than 0.5 wt %. The steel cords are multi-strand cords, e.g. of the 7×7 type, i.e. comprising 7 strands with each 7 wires, such as 7×7×0.22, 7×7×0.25, wherein the number with decimal point designates the diameter of each wire, expressed in mm.

The steel cords are extruded with polypropylene and preferably the thickness of coating is 1.5 mm. The yarns are preferably polypropylene and have a diameter of 0.2 mm assuming round yarn shape.

FIG. 2 shows a schematic diagram of a warp knitted fabric 20 which can be represented by stitch notation. As shown in FIG. 2, half of the steel cords 24 are worked into the loop of the stitches 23 at the stitch line 27, and half of the steel cords 22 are worked alternating into the loop of one stitch line 27*a* and subsequently into the loop of an adjacent stitch line 27*b*,27*c*. In this way more than one metal element can be incorporated into a single plane parallel array. Each metal element is held between the legs of a stitch 28 and an underlap 29, so the elements are held strongly in position. As an example, the width of the strip is in the range of 20 to 100 cm, such as 30 or 40 cm.

As another example, a composite fabric in a form of strip is wrapped or wound around the core 12 covered with a filter fabric 14. Instead of the half of the steel cords 22 in the example shown in FIG. 2, elongated elements made from fibers are used alternatively with the steel cores 24.

As an alternative solution, the metal or composite fabric is first braided or knitted on the non-woven filter fabric 14. In such a case, the metal or composite fabric and the filter fabric 14 are preferably both in the form of strip and have a similar width, e.g. 50 cm. Then the metal or composite fabric and the filter fabric 14 can be applied in one wrapping step.

As a last step, a braided jacket is preferably applied on top of the metal or composite fabric to further protect the rope. The braided jacket can be made from polyester although other jacket materials are possible.

As yet another example, two metal fabric layers are applied on the top of the filter fabric 14. One metal fabric layer is formed by warping a strip, e.g. as shown in FIG. 2, with an inclination angle of 42° to the longitudinal direction of the rope, and another metal fabric layer is formed by warping a strip with an inclination angle of −42° to the longitudinal direction of the rope. The cut resistance of such a rope was tested and the rope appeared less than 10% damage after a displacement of 120 m in severe conditions with a load of 265 kN and a rope displacement of 0.4 m/s.

LIST OF REFERENCES

10 rope
12 core
13 synthetic yarns
14 filter fabric
16 metal fabric

18 jacket
20 warp-knitted fabric
22, 24 steel cords
27, 27*a*, 27*b*, 27*c* stitch line
28 legs of a stitch
29 underlap

The invention claimed is:

1. A rope comprising a core for providing strength to said rope, wherein at least a metal or composite fabric comprising multiple substantially parallel elongated metal elements is provided around said core for protecting said core from impact and cutting, and wherein said multiple substantially parallel elongated elements are in the warp direction and held by yarns, wherein said multiple substantially parallel elongated metal elements are individually coated with a polymer.

2. The rope according to claim 1, wherein the composite fabric further comprises multiple substantially parallel elongated fiber or polymer elongated elements alternating with the multiple substantially parallel elongated metal elements.

3. The rope according to claim 1, wherein said metal or composite fabric is a woven fabric or a warp knitted fabric.

4. The rope according to claim 1, wherein said metal or composite fabric is in a form of strip and said strip is helically wrapped around said core.

5. The rope according to claim 4, wherein two layers of metal or composite fabrics are wrapped around said core with an angle in the range of 20° to 60° for one metal or composite fabric layer and with an angle in the range of −60° to −20° for another metal or composite fabric layer.

6. The rope according to claim 1, wherein said core is made from synthetic material.

7. The rope according to claim 1, wherein said multiple substantially parallel elongated metal elements are steel cords.

8. The rope according to claim 1, wherein the diameter of said multiple substantially parallel elongated metal elements is in the range of 1 to 3 mm.

9. The rope according to claim 1, wherein the thickness of the polymer coating is in the range of 0.05 to 1 mm.

10. The rope according to claim 1, wherein the polymer coating is any one selected from polyamide (PA), polyethylene (PE), polyethylene terephthalate (PET), polypropylene (PP), polyurethane (PU), polysulfone (PES), ethylene tetrafluoroethylene (ETFE) or their combination.

11. The rope according to claim 1, wherein the yarns are made from a same material as the polymer coating on said multiple substantially parallel elongated metal elements.

12. The rope according to claim 1, wherein said metal or composite fabric is an open fabric having a cover factor in the range of 0.5 to 0.9.

13. A method of using a rope according to claim 1 comprising the steps of:

wrapping the rope around a structure in a way such that said rope is used as a mooring line or a submarine rope.

14. A rope comprising a core for providing strength to said rope, wherein at least a metal or composite fabric comprising multiple substantially parallel elongated metal elements is provided around said core for protecting said core from impact and cutting, said composite fabric comprises multiple substantially parallel elongated fiber or polymer elongated elements alternating with the multiple substantially parallel elongated metal elements, said metal or composite fabric is a woven fabric or a warp knitted fabric, and wherein said multiple substantially parallel elongated elements are in the warp direction and held by yarns, wherein said multiple substantially parallel elongated metal elements are individually coated with a polymer.

* * * * *